US008800891B2

(12) United States Patent
Cheng

(10) Patent No.: US 8,800,891 B2
(45) Date of Patent: Aug. 12, 2014

(54) SHOWER SOAP DISPENSER AND CARTRIDGE

(71) Applicant: Mengfeng Cheng, Taichung (TW)

(72) Inventor: Mengfeng Cheng, Taichung (TW)

( * ) Notice: Subject to any disclaimer, the term of this patent is extended or adjusted under 35 U.S.C. 154(b) by 136 days.

(21) Appl. No.: 13/693,098

(22) Filed: Dec. 4, 2012

(65) Prior Publication Data

US 2014/0151464 A1 Jun. 5, 2014

(51) Int. Cl.
*B05B 7/32* (2006.01)
*A47K 5/12* (2006.01)

(52) U.S. Cl.
CPC ..... *A47K 5/1211* (2013.01); *Y10S 4/903* (2013.01)
USPC ..... 239/313; 239/310; 239/318; 239/321; 239/373; 239/525; 239/581.1; 4/903

(58) Field of Classification Search
USPC ..... 239/302, 310, 313, 318, 320, 321, 373, 239/525, 581.1; 4/615, 903
See application file for complete search history.

(56) References Cited

U.S. PATENT DOCUMENTS 1,736,803 A * 11/1929 Shields et al. ..... 239/313
3,907,203 A 9/1975 Skillings
4,047,541 A 9/1977 Mercier et al.
4,840,311 A 6/1989 Shamblin
5,071,070 A 12/1991 Hardy
5,562,248 A 10/1996 Khalifka
5,915,622 A 6/1999 Foote
6,926,212 B1 * 8/2005 Glass ..... 239/313
8,070,074 B2 * 12/2011 Craig ..... 239/321
2007/0163040 A1 7/2007 Bertrand
2010/0213279 A1 8/2010 Frederick
2011/0024457 A1 2/2011 Somerfield
2012/0080109 A1 4/2012 Li et al.

FOREIGN PATENT DOCUMENTS

TW I280874 B 5/2007

* cited by examiner

*Primary Examiner* — Steven J Ganey
(74) *Attorney, Agent, or Firm* — Alan Kamrath; Kamrath IP Lawfirm, P.A.

(57) ABSTRACT

A shower soap dispenser contains: a water pipe for guiding shower water to a shower head from a water supply pipe, a shower soap cartridge fixed on a pipe joint of the water pipe, and an on/off valve installed on the water pipe. The water pipe includes two feeding holes for guiding soap liquid in the pipe joint into the water pipe to further mix the soap liquid with shower water. The shower soap cartridge including a body, a seal element fixed in the body, a plug, a cover, and a resilient element. The soap liquid is stored between the seal element and the plug. Thereby, the resilient element indirectly acts on the seal element to produce self-sealing effect and is removed from the water pipe randomly, and soap liquid in the shower soap cartridge will not leak. Accordingly, different shower soap cartridges are capable of being removed or replaced.

21 Claims, 13 Drawing Sheets

SHOWER SOAP DISPENSER AND CARTRIDGE

FIELD OF THE INVENTION

The present invention relates to a shower soap dispenser and cartridge.

BACKGROUND OF THE INVENTION

It is well known that many shower heads are provided with soap liquid, shower cream, shampoo so that users take a shower.

Shower equipment with liquid dispenser is disclosed in U.S. Pat. No. 3,907,203 and includes a supply unit for supplying soap liquid, cologne liquid or other liquid additives into a first outlet via a channel. The first outlet is fixed over a second outlet of a shower head. The liquid additives are sprayed toward a diffuser plate and then flow downwardly to further mix with water flowing out of the shower head.

However, the liquid additives of the supply unit are guided into the shower head directly, a flow tunnel of a pipe through the channel, or an opening of a distal end of the channel, wherein the pipe connects with the shower head. The flow tunnel has a decreased portion defined therein relative to the opening of the channel, such that after water flows through the flow tunnel, a vacuum suction force produces in the opening so as to suck the liquid additives into the flow tunnel, such that the liquid additives mix with the water, hence the user allows taking a shower. Such shower equipment is embodied by ways of Venturi tube principle, and other shower equipments embodied by using Venturi tube principle are disclosed in U.S. Pat. No. 5,071,070, US Publication No. US2007/0163040A1 and US2012/0080109A1. In addition, U.S. Pat. No. 5,562,248 discloses a switch is fixed on the opening so as to control outflow of the liquid additives. Some shower soap dispensers are integrally connected with a shower head as disclosed in U.S. Pat. No. 5,562,248.

But above-mentioned shower equipments/shower soap dispensers still have some defects. For example, a back pressure generates as the user adjusts a watering mode of the shower head, so wash water mixed from the liquid additives and the water flows back to the supply unit, thus deteriorating the liquid additives. In addition, the opening is blocked by impurities in the water. Also, if these shower equipments/shower soap dispensers operate at a low water pressure, the liquid additives cannot be sucked into the flow tunnel. It is to be noted that since these shower equipments/shower soap dispensers are embodied by ways of Venturi tube principle, a diameter of flowing water has to be diminished, so the shower head can not supply water fully, thus lowering shower efficiency.

Although the diameter of the opening is reduced to enhance the vacuum suction force of the opening, the outflow of the liquid additives is limited.

A shower spa fixture and cartridge is disclosed in U.S. Pat. No. 5,915,622 and is embodied by means of Venturi tube principle, wherein water close to an upper channel of a pipe is guided to flow into a container and to mix with two additives, and then the water mixed with the two additives is supplied to a shower head via a lower channel of the pipe. Nevertheless, such shower spa fixture and cartridge still has above-described shortcomings.

A shower head liquid dispenser disclosed in U.S. Pat. No. 4,047,541 contains a water flow controlling structure mounted in a lower end of a channel of a pipe, like a lip-shaped element, such that a water pressure is increased to push a plug in a cartridge, and liquid additives in the cartridge are pressed into a lower end of the channel of the pipe and then are delivered into a shower head. Also, a spring clip is used to control a tunnel of a hose so as to start/stop a supply of the liquid additives and to adjust the outflow of the liquid additives. A compression spring is applied to push the plug back to an original position. But this shower head liquid dispenser has to use the water pressure to resist against an elasticity of the compression spring and a resistance of the liquid additives in the hose. Unfortunately, a pressing force of the liquid additives is reduced or failed at a low water pressure. Furthermore, the spring clip looses easily without stopping the flowing of the liquid additives. A similar shower dispensing head is disclosed in U.S. Pat. No. 4,840,311, but liquid additives are not delivered into a shower head, the liquid additives flows out of an outlet outside the shower head.

Also, a shower soap dispenser is disclosed in US Publication No. 2011/0024457A1 and contains a turbine blade driven by waterpower so as to drive a pump, such that a supply of soap liquid is achieved. However, this shower soap dispenser operates badly at a lower water pressure and lowers a water supply.

An automatic fluid dispenser is disclosed in US Publication No. 2010/0213279 and contains a pump driven by electricity so as to supply soap liquid. Also, a similar fluid dispenser is disclosed in TW Patent No. 1280874. Yet such a fluid dispenser is complicated and is produced at a high cost. Likewise, it operates at high power consumption and causes power leakage and short circuit.

The present invention has arisen to mitigate and/or obviate the afore-described disadvantages.

SUMMARY OF THE INVENTION

The primary object of the present invention is to provide a shower soap dispenser and cartridge which is capable of overcoming the shortcomings of the conventional shower soap dispenser and cartridge.

To obtain the above objectives, a shower soap dispenser provided by the present invention contains:

a water pipe including an upper segment for connecting with the water supply pipe, a lower segment for coupling with the shower head, and a seat defined between and communicating with the upper segment and the lower segment; a channel passing through the upper segment, the lower segment, and the seat; a pipe joint connecting with the seat and extending outwardly from an outer wall of the water pipe; the seat having a groove defined therein and communicating with the channel; the pipe joint having a tunnel defined therein; at least one feeding hole formed on the seat so as to communicate with the groove and the tunnel; the pipe joint also having an abutting portion and at least one orifice defined on a distal end thereof;

a shower soap cartridge including a body, a seal element, a plug, a cover, and a resilient element, wherein the body has a chamber portion, a first connecting portion mounted on one end of the chamber portion, and a second connecting portion disposed on another end of the chamber portion; the chamber portion has a cylindrical cavity defined therein; the first connecting portion is coupled with the pipe joint of the water pipe and has an outlet communicating with the cylindrical cavity, and a diameter of the outlet is smaller than that of the cylindrical cavity, the second connecting portion has an intake communicating with the cylindrical cavity;

the seal element is placed into the body from the intake and axially moves in the cylindrical cavity so as to stop the outlet communicating with the cylindrical cavity; and between an external rim of the seal element and the cylindrical cavity is defined a slit; when the first connecting portion of the body couples with the pipe joint of the water pipe, the seal element is pushed by the abutting portion of the pipe joint to move toward the intake, thus removing from the outlet;

the plug is placed into the body from the intake and axially moves in the cylindrical cavity, such that between the plug and the seal element is defined a store room so as to store a soap filled from the intake of the body, and as the soap runs out, the plug is biased against the seal element;

the cover is connected with the second connecting portion of the body so as to close the intake;

the resilient element is fixed between the cover and the plug so that the plug is pushed by the resilient element to press a soap in the store room toward the outlet during which the soap forces on the seal element, so before the first connecting portion of the body couples with the pipe joint of the water pipe, the seal element stops the outlet communicating with the cylindrical cavity, and when the first connecting portion of the body is in connection with the pipe joint of the water pipe, the soap is pressed into the tunnel from the slit through the at least one orifice;

an on/off valve is installed on the seat of the water pipe and includes a housing fixed in the groove and moving between a close position and an open position, the housing includes a valve hole communicating with the channel and closes the at least one feeding hole when the on/off valve is fixed at the close position, such that a soap in the tunnel of the pipe joint does not flow into the channel via the at least one feeding hole, and when the on/off valve is fixed at the open position, the housing removes from the at least one feeding hole, so the soap in the tunnel of the pipe joint flows into the channel via the at least one feeding hole and then mixes with a shower water flowing through the channel so as to produce a shower soap water, thereafter the shower soap water is guided into the shower head.

Preferably, the seat has a horizontal through aperture passing through the channel so as to define the groove in the seat, and a diameter of the horizontal through aperture is greater than that of the channel so that the groove has two fixing walls defined on two sides thereof and two opposite concave faces formed between the two fixing walls, wherein one of the two concave faces is adjacent to the pipe joint and passing through the two feeding holes; the housing is formed in a column shape and rotates between the close position and the open position; the housing also has a passage defined on a middle portion thereof so as to form the valve hole and has two opposite convex faces defined on an outer surface of the middle portion thereof so as to contact with the two concave faces of the seat; the housing further has two closing walls arranged on two sides of the two convex faces thereof so as to close the two fixing walls and has two coupling portions mounted on two sides of the closing walls thereof; the on/off valve further includes two rotatable knobs disposed on the two sides of the groove of the seat and coupling with the two coupling portions of the housing so that the housing is axially limited in the groove, and each rotatable knob is rotated to drive the housing.

Preferably, the housing has two opposite notches and two opposite cutouts defined on each coupling portion; the two rotatable knobs are formed in a sleeve shape and are fitted onto the two coupling portions, wherein each rotatable knob has two opposite hooks and two opposite insertions fixed therein, such that the two hooks retain with the two notches, so the two rotatable knobs connect with the two coupling portions, and the two insertions are inserted into the two cutouts so that the two rotatable knobs rotate circumferentially along the two coupling portions of the housing.

Preferably, an extending direction of the two feeding holes is identical to that of the pipe joint, and the two feeding holes and the pipe joint incline toward the upper segment, such that an angle is defined between an axial line of the pipe joint and that of the channel, and the angle is between 30 and 60 degrees.

Also, a shower soap cartridge provided by the present invention contains:

a body including a chamber portion, a first connecting portion mounted on one end of the chamber portion, and a second connecting portion disposed on another end of the chamber portion; the chamber portion including a cylindrical cavity defined therein; the first connecting portion being coupled with the pipe joint of the water pipe and having an outlet communicating with the cylindrical cavity, and a diameter of the outlet being smaller than that of the cylindrical cavity, the second connecting portion having an intake communicating with the cylindrical cavity;

a seal element being placed into the body from the intake and axially moving in the cylindrical cavity so as to stop the outlet communicating with the cylindrical cavity; and between an external rim of the seal element and the cylindrical cavity being defined a slit; when the first connecting portion of the body couples with the pipe joint of the water pipe, the seal element being pushed by the abutting portion of the pipe joint to move toward the intake, thus removing from the outlet;

a plug being placed into the body from the intake and axially moving in the cylindrical cavity, such that between the plug and the seal element is defined a store room so as to store a soap filled from the intake of the body, and as the soap runs out, the plug being biased against the seal element;

a cover being connected with the second connecting portion of the body so as to close the intake;

a resilient element fixed between the cover and the plug so that the plug is pushed by the resilient element to press a soap in the store room toward the outlet during which the soap forces on the seal element, so before the first connecting portion of the body couples with the pipe joint of the water pipe, the seal element stopping the outlet communicating with the cylindrical cavity, and when the first connecting portion of the body is in connection with the pipe joint of the water pipe, the soap being pressed into the pipe joint from the slit through at least one orifice of the pipe joint.

Thereby, the shower soap dispenser of the present invention is operated easily by rotating the two rotatable knobs of the on/off valve to the open position or the close position so as to supply soap or to stop supplying soap. In addition, the soap is fed into the shower water by means of the spring without decreasing water flow. Also, soap supply will not be influenced by water pressure. In other words, the soap is supplied well at a lower water pressure. Therefore, the disadvantages of conventional soap supply by using waterpower or electricity to drive pump is eliminated.

Preferably, the shower soap cartridge includes the spring for indirectly acting on the seal element so as to produce the self-sealing effect, the shower soap cartridge is removed from the water pipe randomly, and a soap liquid in the shower soap cartridge will not leak. Accordingly, different shower soap cartridges are capable of being removed or replaced according to using requirement.

In addition, the water pipe of the shower soap dispenser 1 extends outwardly along the water supply and the shower head, and the shower soap cartridge obloquies toward the upper segment of the water pipe, so the shower soap cartridge doesn't interfere the user or is hit by the user in a shower.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
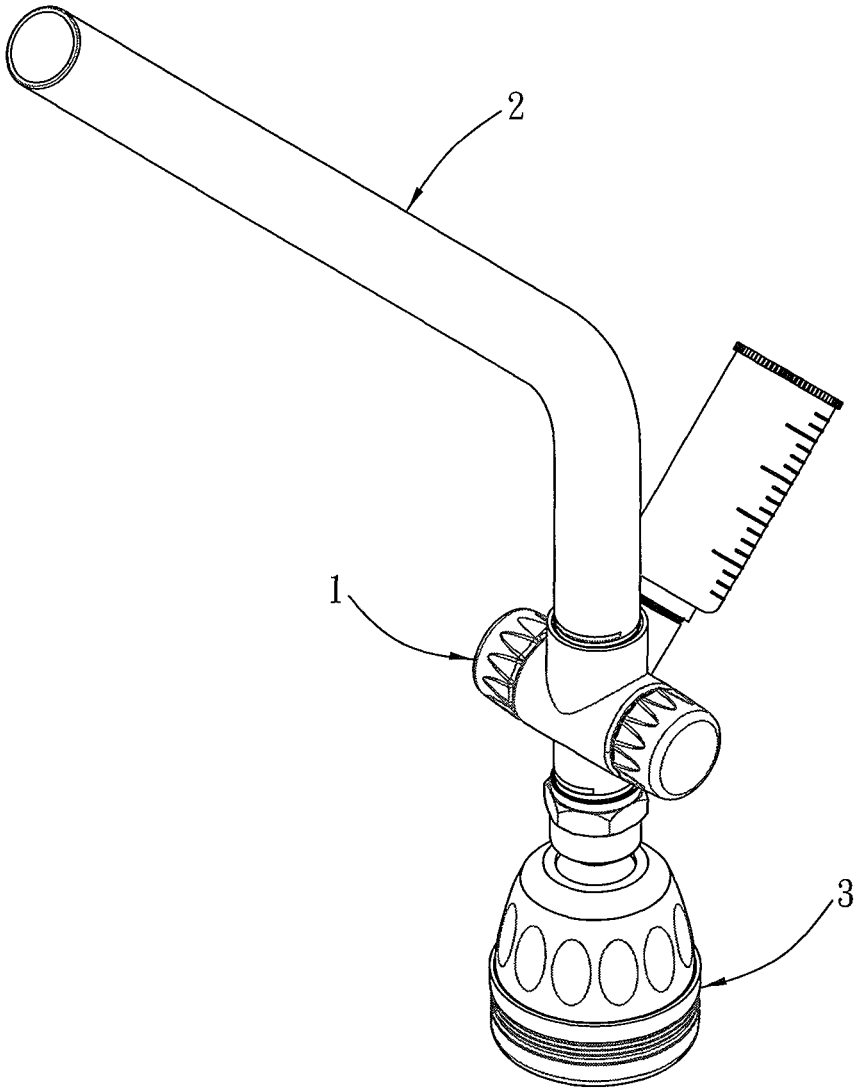
FIG. 1 is a perspective view showing a shower soap dispenser being installed between a water supply and a shower head according to the present invention.
Figure 2:
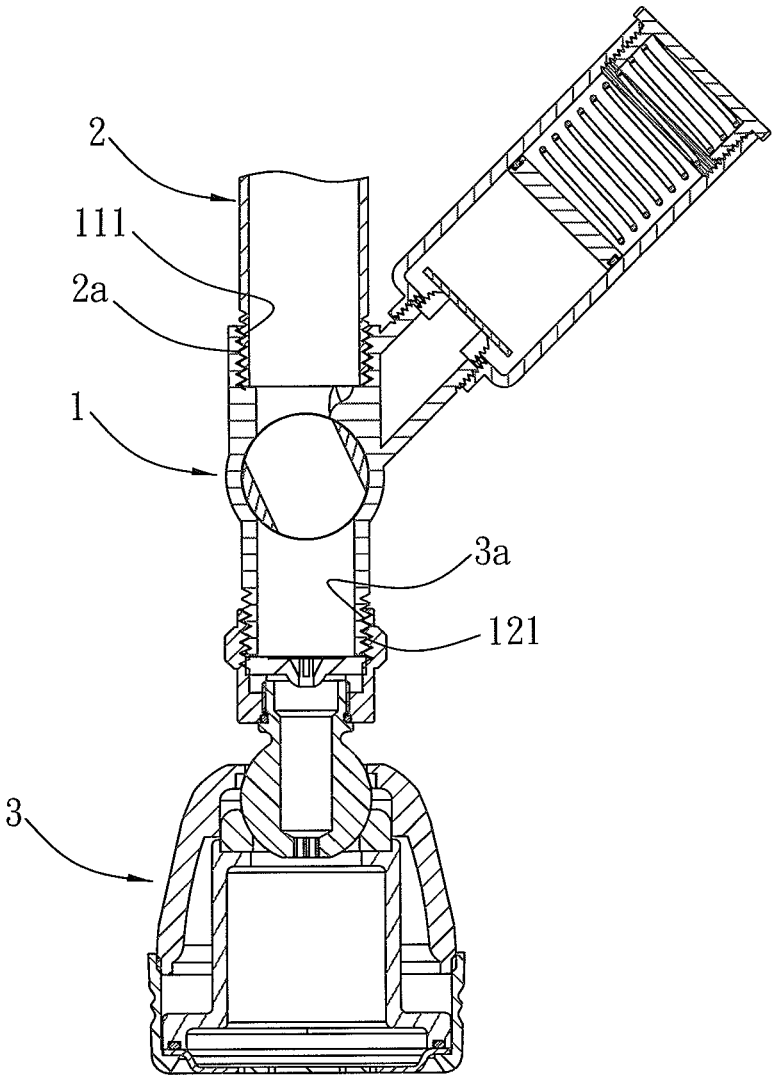
FIG. 2 is a partial cross sectional view of FIG. 1 and showing an on/off valve of the present invention being shifted to a close position.

FIGS. 1 and 2 show a shower soap dispenser according to a preferred embodiment of the present invention. The shower soap dispenser 1 is installed in a shower system, such as a shower head 3 connecting with a water supply pipe 2. Typically, the water supply pipe 2 has first outer threads 2*a* for screwing with first inner threads 3*a* of the shower head 3. In this embodiment, the shower soap dispenser 1 is fixed between the water supply pipe 2 and the shower head 3.

Referring further to FIGS. 3-6, the shower soap dispenser 1 includes a water tube 10, a shower soap cartridge 20, and an on/off valve 30.

The water pipe 10, as shown in FIGS. 7-10, is formed in a cross shape, includes an upper segment 11 for connecting with the water supply pipe 2, includes a lower segment 12 for coupling with the shower head 3, and includes a seat 13 defined between and communicating with the upper segment 11 and the lower segment 12. The water pipe 10 also includes: a channel 14 passing through the upper segment 11, the lower segment 12, and the seat 13; a pipe joint 15 connecting with the seat 13 and extending outwardly from an outer wall 101 of the water pipe 10. The seat 13 has a groove 131 defined therein and communicating with the channel 14. The pipe joint 15 has a tunnel 151 defined therein. The water pipe 10 further includes two feeding holes 16 formed on the seat 13 so as to communicate with the groove 131 and the tunnel 151. The pipe joint 15 also has an abutting portion 152 arranged on an end portion of a distal end thereof and has two orifices 153 symmetrically defined on a surface thereof.

As shown in FIG. 2, the upper segment 11 has an inner threaded section 111 formed on an opening thereof so as to screw with the first outer threads 2*a* of the water supply pipe 2, such that the water pipe 10 is connected with the water supply pipe 2. Also, the lower segment 12 has an outer threaded section 121 formed on an opening thereof so as to screw with the first inner threads 3*a* of the shower head 3, such that the water pipe 10 is connected with the shower head 3. In addition, the water pipe 10 is also capable of connecting with the water supply pipe 2 and the shower head 3 by ways of other connecting components, such as a quick connector, etc.

With reference to FIGS. 7-10, the seat 13 has a horizontal through aperture passing through the channel 14 so as to define the groove 131 in the seat 13, and a diameter of the horizontal through aperture is greater than that of the channel 14 so that the groove 131 has two fixing walls 132 defined on two sides thereof and two opposite concave faces 133 formed between the two fixing walls 132, wherein one of the two concave faces 133 is adjacent to the pipe joint 15 and passing through the two feeding holes 16.

Figure 4:
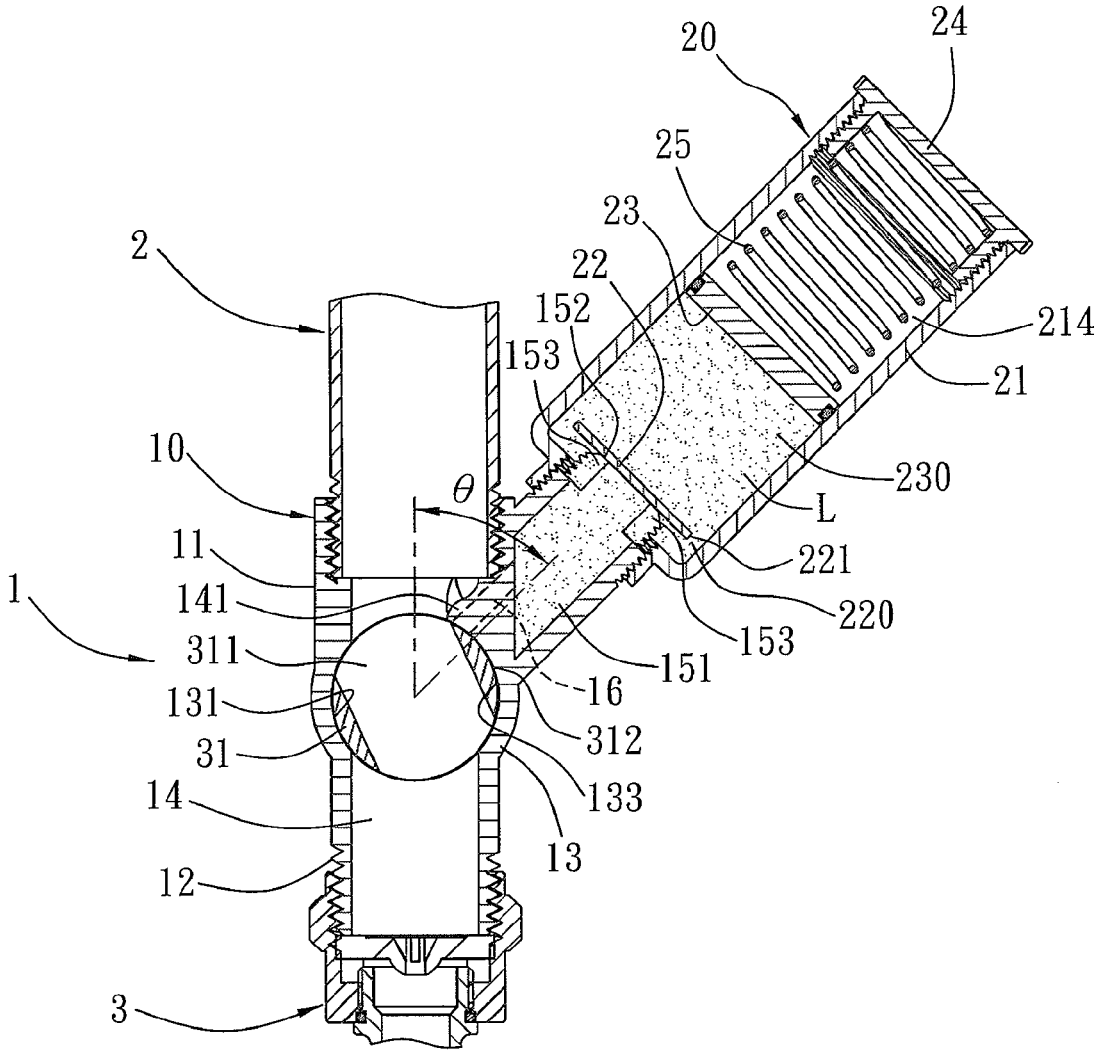
FIG. 4 is a cross sectional view of a part of FIG. 2.
Figure 5:
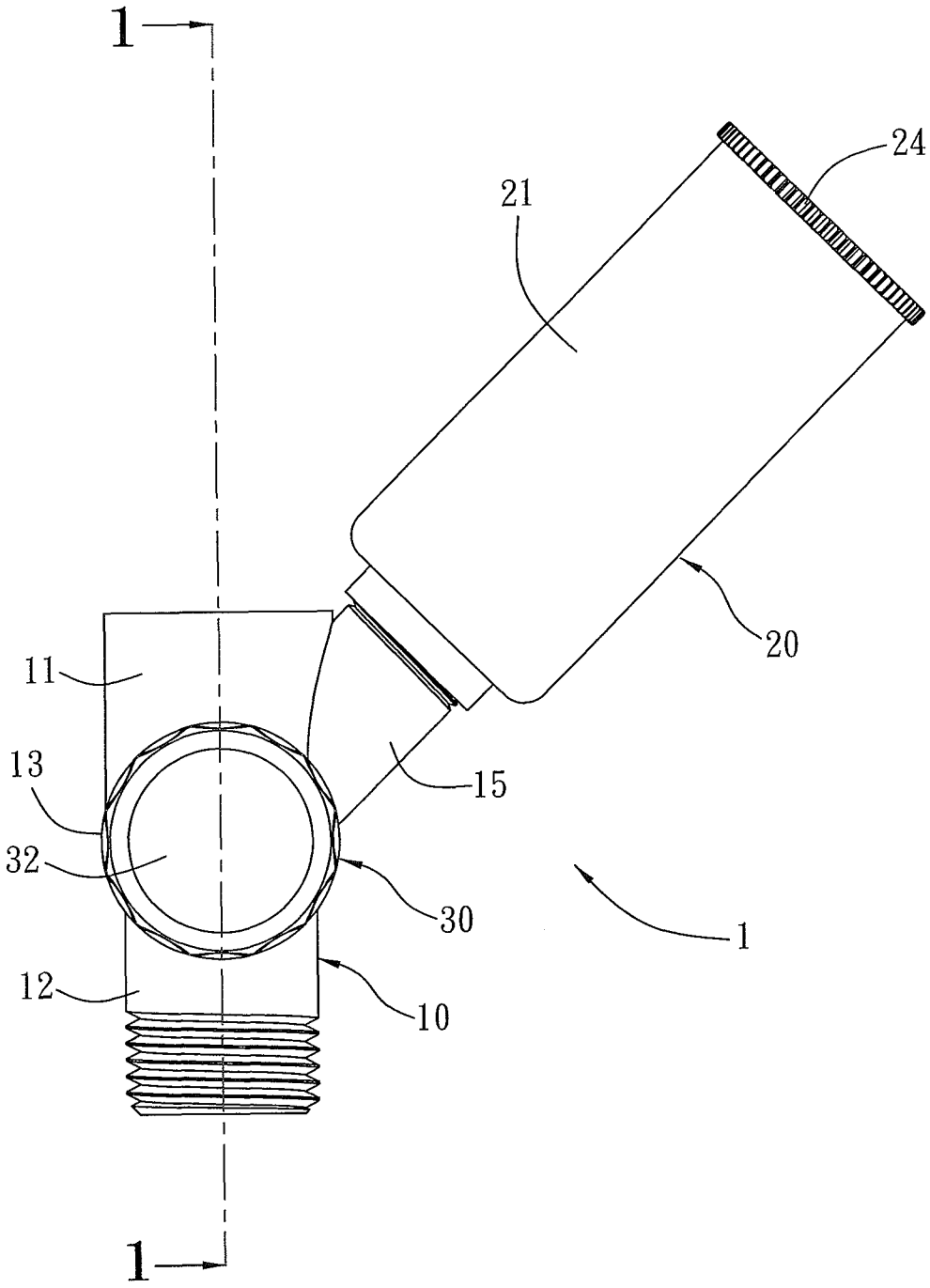
FIG. 5 is a plan view showing the assembly of the shower soap dispenser according to the present invention.
Figure 10:
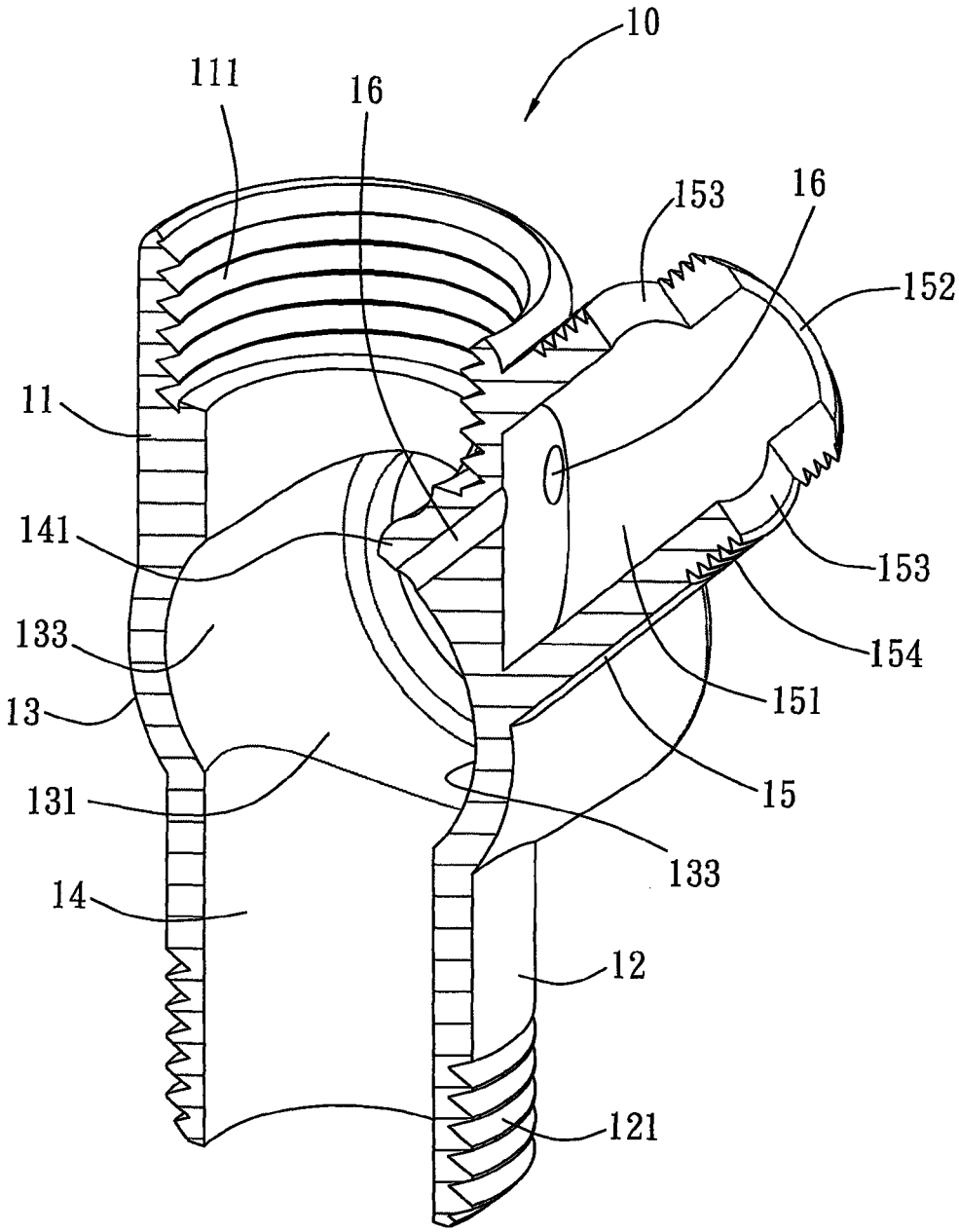
FIG. 10 is a cross sectional view taken along the lines 3-3 of FIG. 9.

Preferably, as illustrated in FIG. 10, the channel 14 of the water pipe 10 has a projected portion 141 defined therein, and a predetermined portion of a concave face 133 adjacent to the pipe joint 15 is formed on the projected portion 141. Also, the two feeding holes 16 pass through the predetermined portion of the concave face 133 which is formed on the projected portion 141. It is preferable that the projected portion 141 is provided to increase an area of the concave face 133 adjacent to the pipe joint 15 so that the two feeding holes 16 are closer to the upper segment 11, thus facilitating a tilted arrangement of the two feeding holes 16 and the pipe joint 15. It is to be noted that an extending direction of the two feeding holes 16 is identical to that of the pipe joint 15, and the two feeding holes 16 and the pipe joint 15 incline toward the upper segment 11 as shown in FIG. 4. Preferably, an angle θ is defined between an axial line of the pipe joint 15 and that of the channel 14, and it is 45 degrees. The angle θ is adjustable based on a size of the water pipe 10 but is also limited between 30 and 60 degrees.

Figure 7:
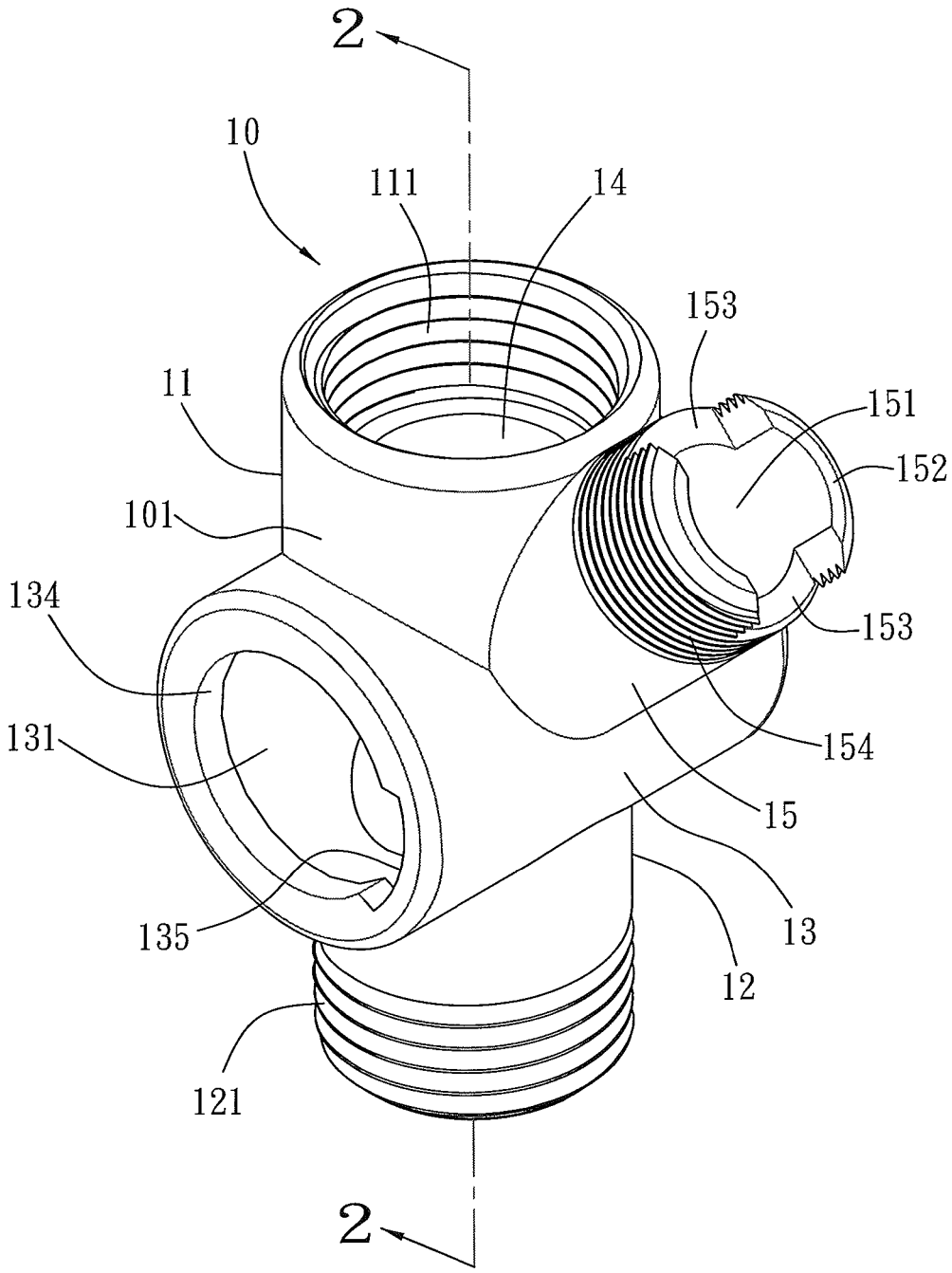
FIG. 7 is a perspective view showing the assembly of a water pipe of the shower soap dispenser according to the present invention.
Figure 8:
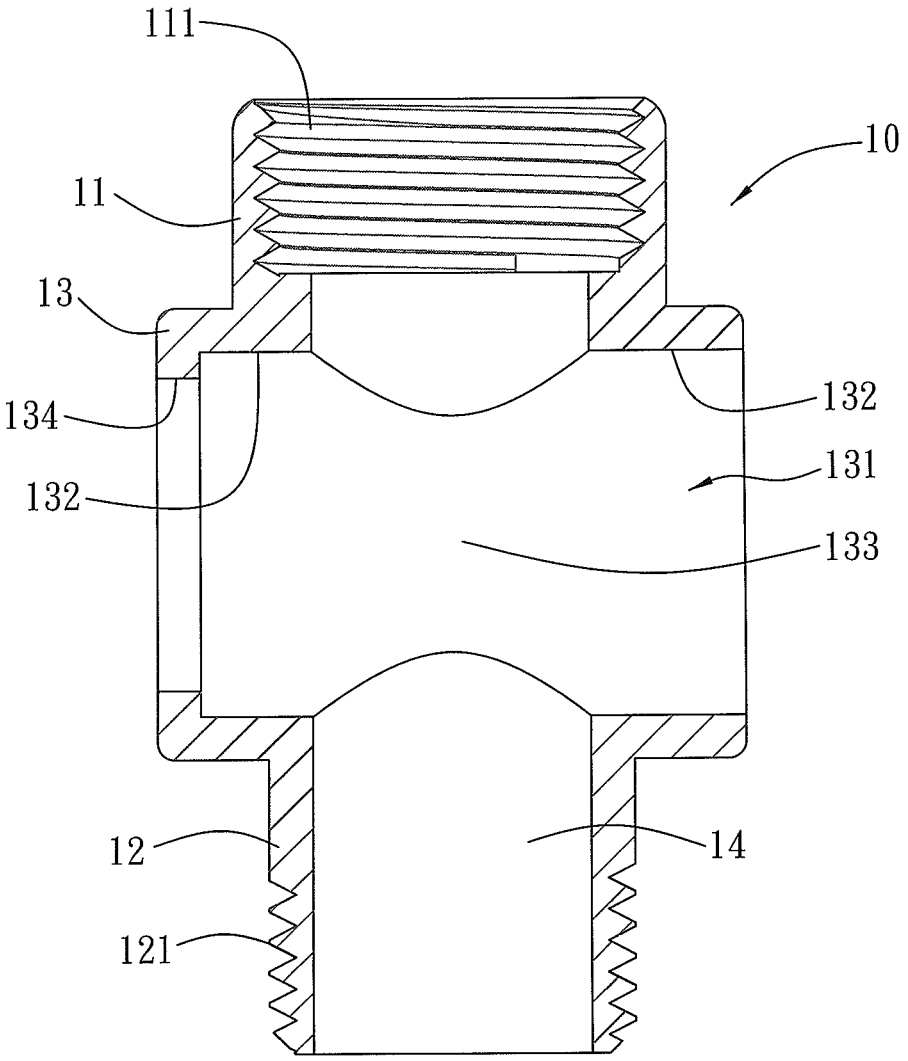
FIG. 8 is a cross sectional view taken along the line 2-2 of FIG. 7.
Figure 9:
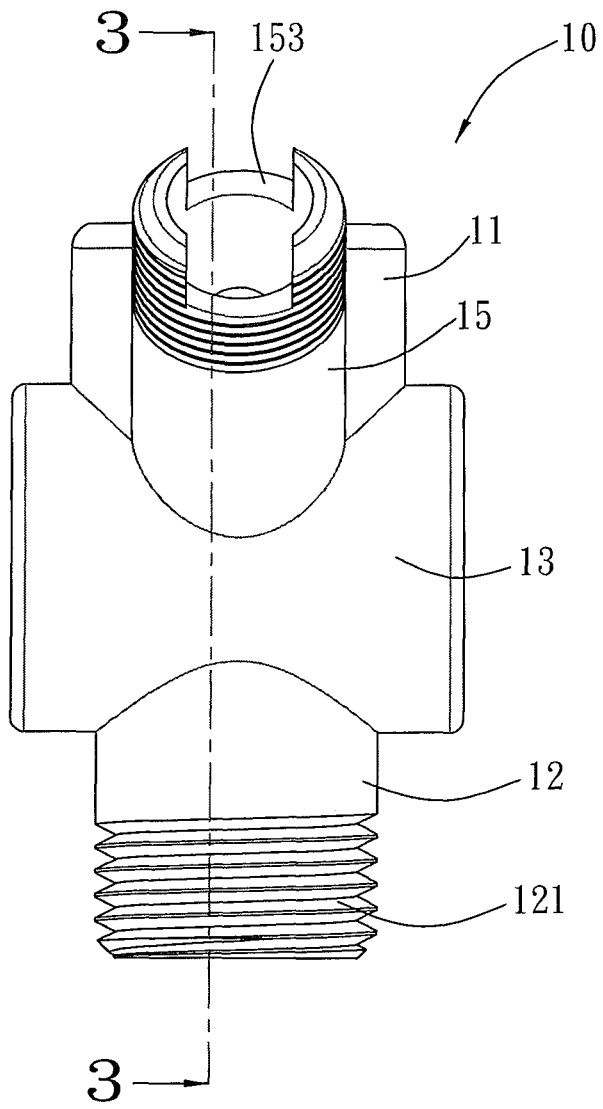
FIG. 9 is a cross sectional view showing the assembly of the water pipe of the shower soap dispenser according to the present invention.

Referring further to FIGS. 7 and 8, the seat 13 also has a circular tab 134 arranged around an opening of one of the two fixing walls 132, and the circular tab 134 has a limit recess 135 defined thereon.

The pipe joint 15 of the water pipe 10 has an outer screwing section 154 formed around an outer surface thereof, and the abutting portion 152 is defined between the outer screwing section 154 and the top end of the pipe joint 15.

Figure 3:
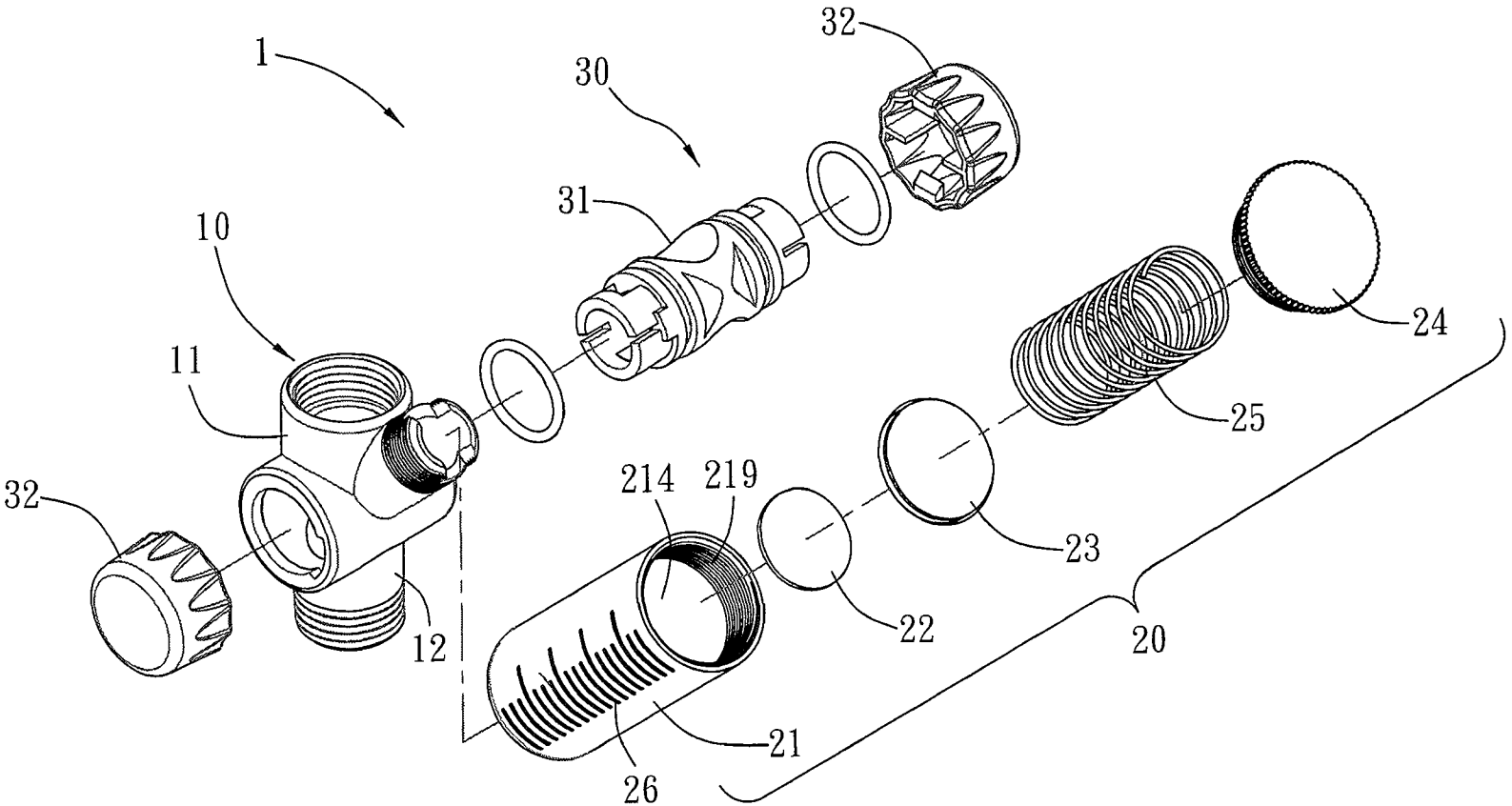
FIG. 3 is a perspective view showing the exploded embodiment of the shower soap dispenser according to the present invention.
Figure 11:
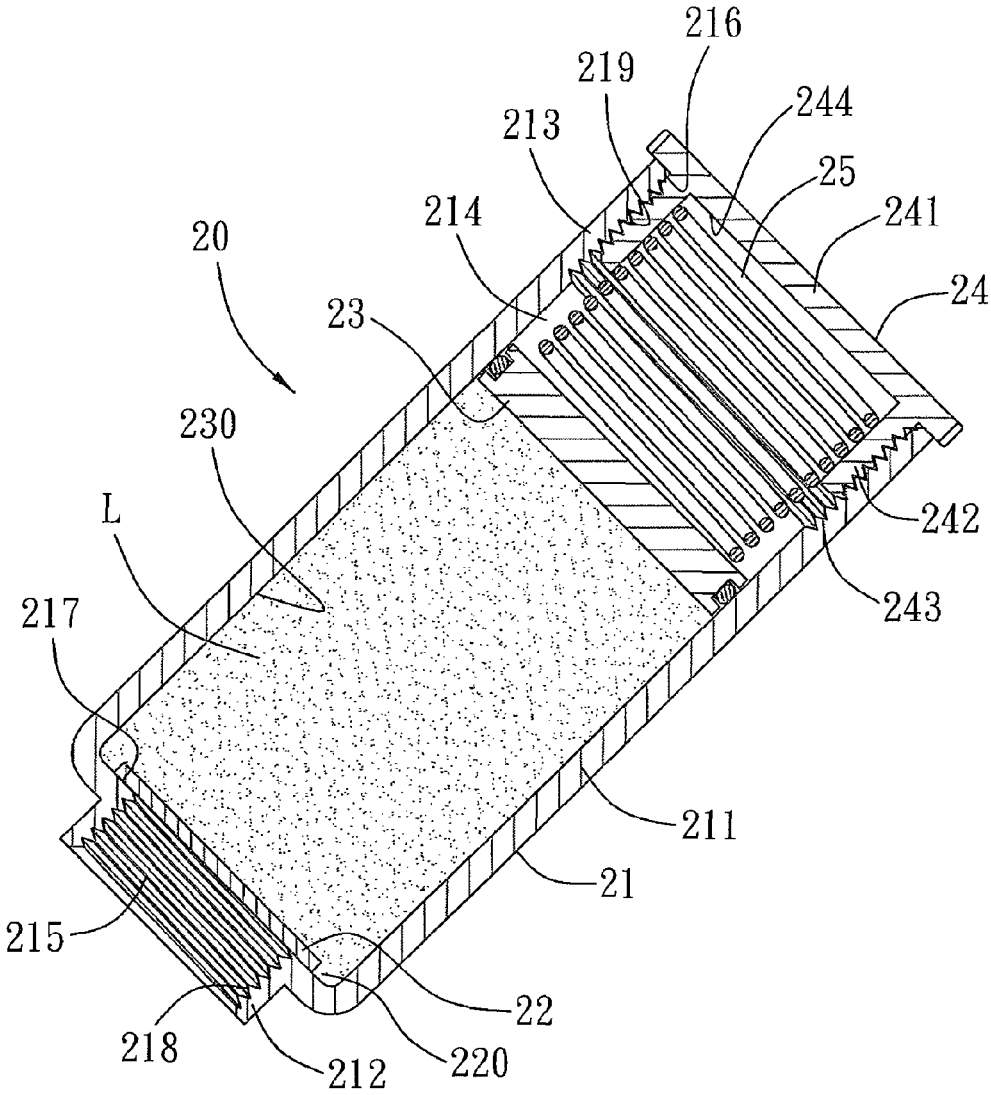
FIG. 11 is a cross sectional view showing the assembly of a shower soap cartridge filled with soap according to the present invention.

As illustrated in FIGS. 3 and 11, the shower soap cartridge 20 includes a body 21, a seal element 22, a plug 23, a cover 24, and a spring 25, wherein the body 21 has a chamber portion 211, a first connecting portion 212 mounted on one end of the chamber portion 211, and a second connecting portion 213 disposed on another end of the chamber portion 211; the chamber portion 211 has a cylindrical cavity 214 defined therein; the first connecting portion 212 is coupled with the pipe joint 15 of the water pipe 10 and has an outlet 215 communicating with the cylindrical cavity 214. The first connecting portion 212 integrally extends outward from the chamber portion 211 and conically becomes decreased, and a diameter of the outlet 215 is smaller than that of the cylindrical cavity 214. In addition, the second connecting portion 213 has an intake 216 formed on an opening thereof so as to fill soap and communicating with the cylindrical cavity 214.

The cylindrical cavity 214 of the body 21 has a closing fence 217 formed therein and around the outlet 215, and the first connecting portion 212 has an inner screwing section 218 arranged around an inner surface of the outlet 215, such that the inner screwing section 218 of the body 21 is screwed with the outer screwing section 154 of the pipe joint 15. The second connecting portion 213 also has second inner threads 219 arranged around an inner surface of the intake 216.

Figure 13:
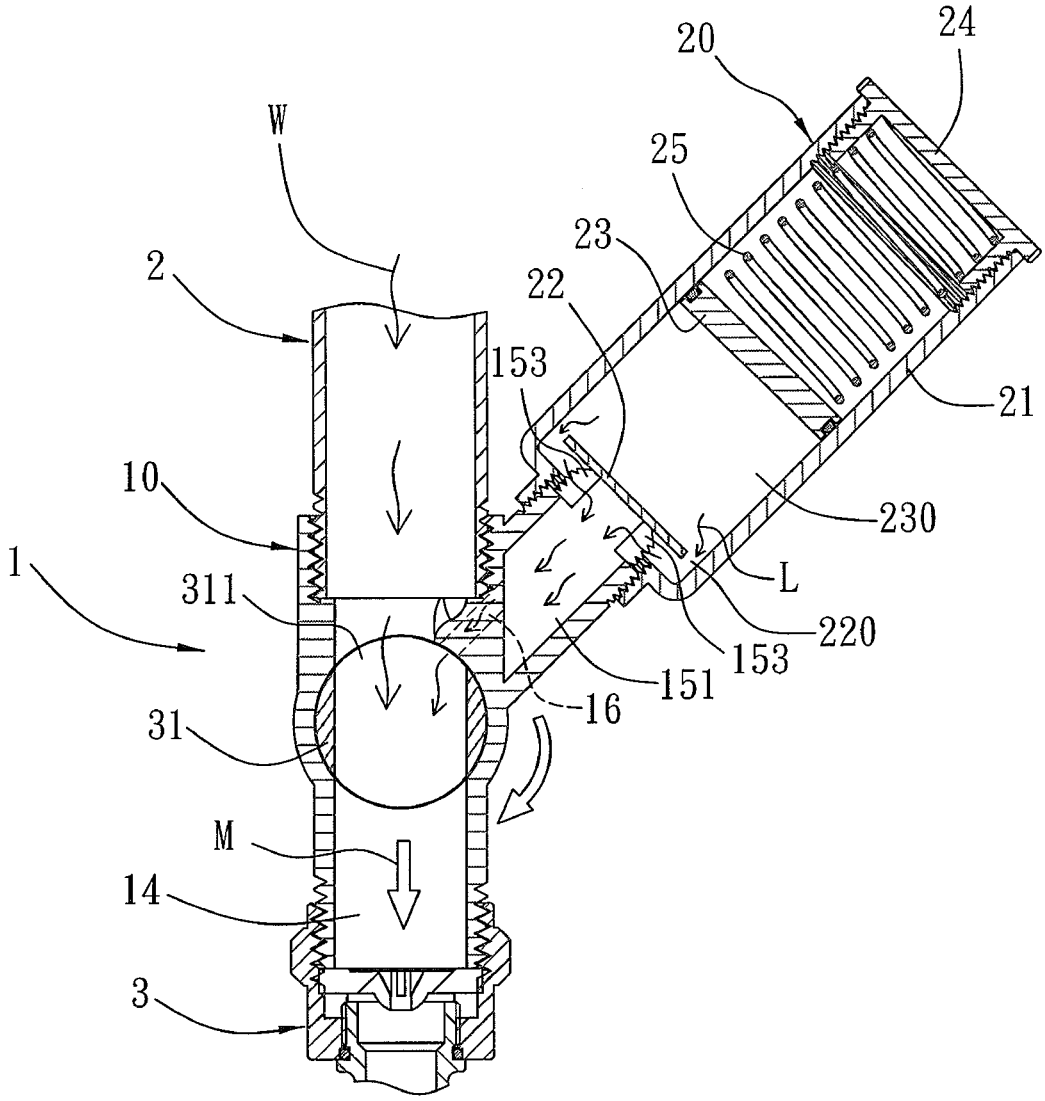
FIG. 13 is a cross sectional view showing the operation of the shower soap dispenser and the shower soap cartridge according to a fourth embodiment of the present invention.

The seal element 22 is placed into the body 21 from the intake 216 and axially moves in the cylindrical cavity 214 so as to stop the outlet 215 communicating with the cylindrical cavity 214, as shown in FIGS. 11 and 13, and between an external rim of the seal element 22 and the cylindrical cavity 214 is defined a slit 220. When the first connecting portion 212 of the body 21 couples with the pipe joint 15 of the water pipe 10, the seal element 22 is pushed by the abutting portion 152 of the pipe joint 15 to move toward the intake 216, thus removing from the outlet 215.

The seal element 22 is circular, and a diameter of the external rim of the seal element 22 is smaller than a diameter of an inner surface of the cylindrical cavity 214, such that the slit 220 is defined between the external rim of the seal element 22 and the inner surface of the cylindrical cavity 214. Also, the seal element 22 is circular so as to contact with the closing fence 217 tightly, thus stopping the outlet 215 communicating with the cylindrical cavity 214.

The plug 23 is placed into the body 21 from the intake 216 and axially moves in the cylindrical cavity 214, such that between the plug 23 and the seal element 22 is defined a store room 230 so as to store a soap liquid L filled from the intake 216 of the body 21 as illustrated in FIG. 11, and as the soap liquid L runs out, the plug 23 is biased against the seal element 22.

The cover 24 is connected with the second connecting portion 213 of the body 21 so as to close the intake 216.

The cover 24 has an end wall 241 formed on a top end thereof and has a peripheral wall 242 integrally extending outward from the end wall 241. The peripheral wall 242 has second outer threads 243 arranged thereon so as to screw with the second inner threads 219 of the second connecting portion 213, such that the cover 24 connects with the body 21, and the end wall 241 of the cover 24 abuts against the intake 216 of the housing 21. The peripheral wall 242 has a slot 244 defined therein so as to receive the spring 25.

The spring 25 is fixed between the slot 244 of the cover 24 and the plug 23 so that the plug 23 is pushed by the spring 25 to press the soap liquid L out of the outlet 215 during which the soap liquid L forces on the seal element 22, so before the first connecting portion 212 of the body 21 couples with the pipe joint 15 of the water pipe 10, the seal element 22 stops the outlet 215 communicating with the cylindrical cavity 214, as shown in FIG. 11. Furthermore, when the first connecting portion 212 of the body 21 is in connection with the pipe joint 15 of the water pipe 10, the soap liquid L is pressed into the tunnel 151 from the slit 220 through the two orifices 153 as illustrated in FIGS. 4 and 13.

Figure 6:
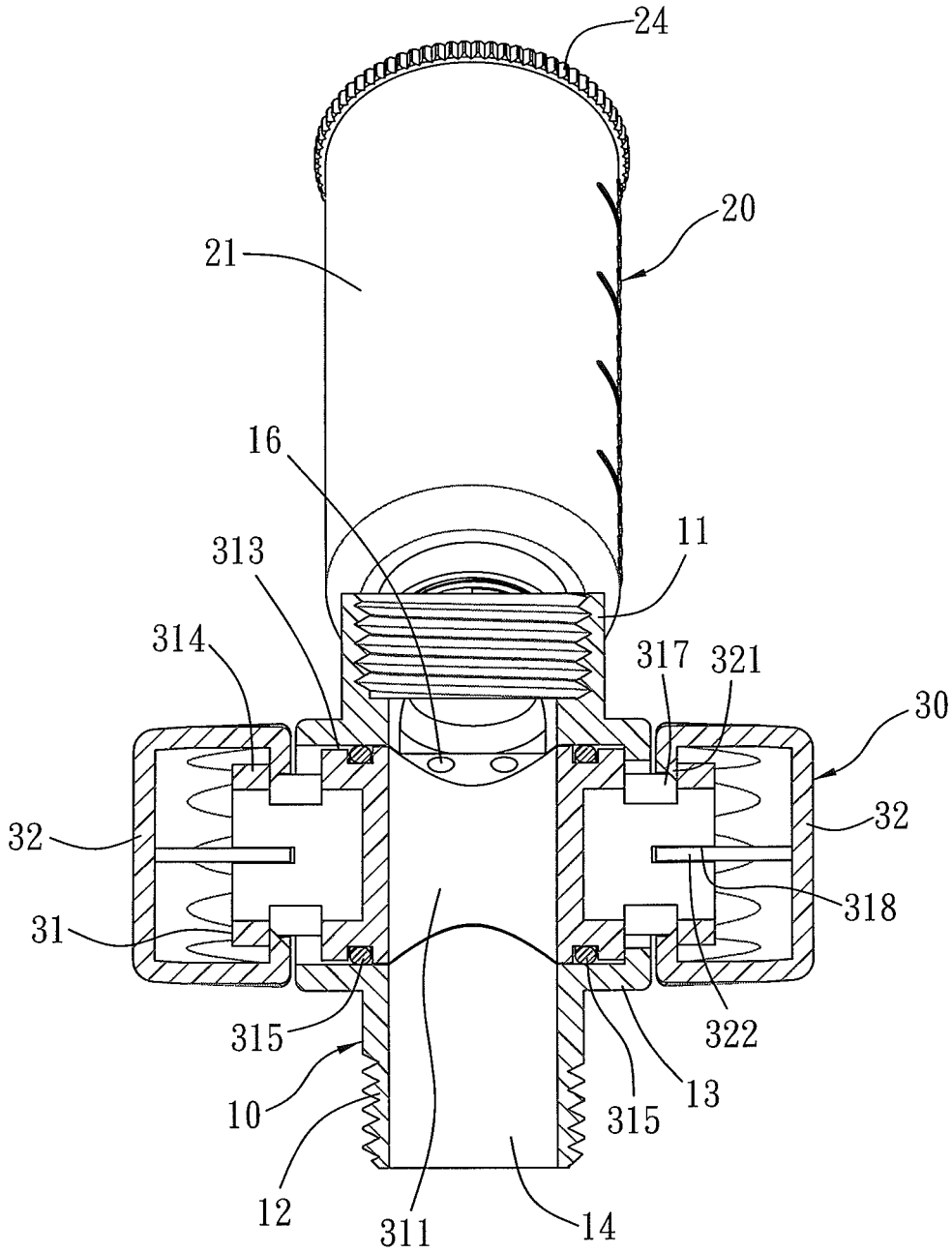
FIG. 6 is a cross sectional view taken along the line 1-1 of FIG. 5.
Figure 12:
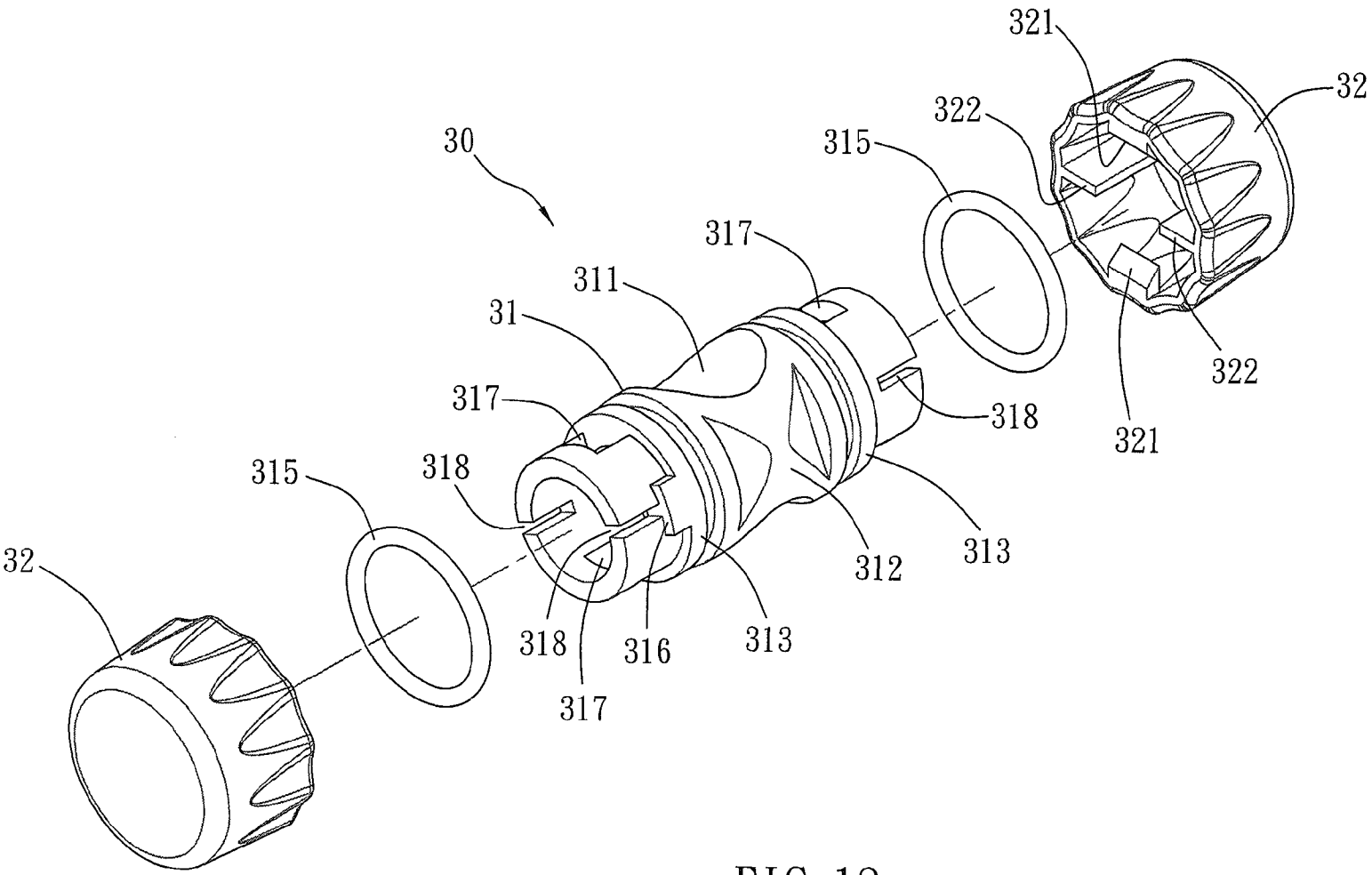
FIG. 12 is a perspective view showing the exploded components of the on/off valve of the shower soap dispenser according to the present invention

Referring further to FIGS. 3, 6, and 12, the on/off valve 30 is installed on the seat 13 of the water pipe 10 and includes a housing 31 fixed in the groove 131 and moving between a close position and an open position. The housing 31 includes a valve hole 311 communicating with the channel 14, and it closes the two feeding holes 16 when the on/off valve 30 is fixed at the close position as shown in FIG. 4, such that a soap liquid L in the tunnel 151 of the pipe joint 15 does not flow into the channel 14 via the two feeding holes 16. Also, when the on/off valve 30 is fixed at the open position, the housing 31 removes from the two feeding holes 16 as illustrated in FIG. 13, so the soap liquid L in the tunnel 151 of the pipe joint 15 flows into the channel 14 via the two feeding holes 16 and then mixes with a shower water W flowing into the channel 14 so as to produce the shower soap water M. Thereafter, the shower soap water M is guided into the shower head 3.

In this embodiment, the housing 31 is formed in a column shape and rotates between the close position and the open position. The housing 31 also has a passage defined on a middle portion thereof so as to form the valve hole 311 and has two opposite convex faces 312 defined on an outer surface of the middle portion thereof so as to contact with the two concave faces 133 of the seat 13. Also, the housing 31 further has two closing walls 313 arranged on two sides of the two convex faces 312 thereof so as to close the two fixing walls 132 and has two coupling portions 314 mounted on two sides of the closing walls 313 thereof.

Referring further to FIGS. 6 and 12, the housing 31 also has two O-shaped rings 315 secured on the closing walls 313 so as to close the two fixing walls 132, such that the shower water W, the soap liquid L or the shower soap water M in the channel 14 does not leak.

As shown in FIG. 12, the on/off valve 30 further includes two rotatable knobs 32 disposed on the two sides of the groove 131 of the seat 13 and coupling with the two coupling portions 314 of the housing 31 so that the housing 31 is axially limited in the groove 131, and each rotatable knob 32 is rotated to drive the housing 31.

Moreover, the housing 31 has a limiting protrusion 316 fixed on a coupling portion 314 relative to the circular tab 134 so that the limiting protrusion 316 is retained in the limit recess 135 of the seat 13 as shown in FIGS. 7 and 12, such that the housing 31 is limited to rotate between the close position and the open position relative to the limit recess 135.

With reference to FIGS. 6 and 12, the housing 31 has two opposite notches 317 and two opposite cutouts 318 defined on each coupling portion 314, and the two rotatable knobs 32 are formed in a sleeve shape and are fitted onto the two coupling portions 314, wherein each rotatable knob 32 has two opposite hooks 321 and two opposite insertions 322 fixed therein, such that the two hooks 321 retain with the two notches 317, so the two rotatable knobs 32 connect with the two coupling portions 314. In addition, the two insertions 322 are inserted into the two cutouts 318 so that the two rotatable knobs 32 rotate circumferentially along the two coupling portions 314 of the housing 31, thus connecting the two rotatable knobs 32 with the housing 31 easily and quickly.

It is to be noted that, as illustrated in FIG. 4, the abutting portion 152 of the pipe joint 15 is provided to push the seal element 22 to remove from the outlet 215, and then the two orifices 153 of the distal end of the pipe joint 15 communicate with the cylindrical cavity 214, such that a soap liquid L in the body 21 flows into the tunnel 151 along the two orifices 153. Accordingly, the two orifices 153 have to be defined on the distal end of the pipe joint 15, and the two orifices 153 are formed by two gaps or two ports located at the distal end of the pipe joint 15. Furthermore, the tunnel 151 of the pipe joint 15 is also capable of providing with a rib structure extending along the tunnel 151, wherein the rib structure has the abutting portion 152, a height of which is greater than that of the distal end of the pipe joint 15, such that after the shower soap cartridge 20 is coupled with the water pipe 10, the seal element 22 is pushed by the abutting portion 152 of the rib structure so as to remove from the outlet 215, and the two orifices 153 are defined in the rib structure or are formed by at least one port between the rib structure and the tunnel 151.

The spring 25 is applied to push the plug 23, and any component for pushing the plug 23 is capable of replacing the spring 25 of the present invention.

The shower soap dispenser 1 is fixed on a wall-fixed shower head 3. The water supply pipe 2 of this shower head 3, is made of metal material, extends outwardly from the wall, and tilts downwardly at a certain angle. Because the angle θ between the axial line of the pipe joint 15 and the axial line of the channel 14 is 30 to 60 degrees, as shown in FIG. 4, the shower soap dispenser 1 is fixed between the water supply pipe 2 and the shower head 3, hence the shower soap cartridge 20 faces upwardly and is in a vertical state or a near-vertical state. Accordingly, the shower soap cartridge 20 will not be hit by a user, and the soap liquid L in the body 21 flows into the tunnel 151 easily by using gravities of the body 21, the spring 25, and the plug 23. Of course, the shower soap cartridge 21 is capable of being fixed on other positions as well.

Referring to FIG. 4, the seal element 22 is circular and its outer diameter is smaller than the inner diameter of the cylindrical cavity 214, yet the outer diameter of the seal element 22 allows being equal to the inner diameter of the cylindrical cavity 214, or between the seal element 22 and the cylindrical cavity 214 are defined a slidable groove and a sliding block for mating with the slidable groove so that the seal element 22 moves in the cylindrical cavity 214 smoothly. Likewise, the slit 220 is formed by providing at least one gap or port around the seal element 22, thus flowing the soap liquid L smoothly.

Preferably, the seal element 22 is spherical and its diameter is limited to be smaller than the inner diameter of the cylindrical cavity 214 and larger than a diameter of the outlet 215. In addition, the slit 220 is defined between a spherical seal element 22 and the cylindrical cavity 214, and the outlet 215 is closed if necessary. Of course, the spherical seal element 22 moves in the cylindrical cavity 214 freely.

Preferably, the shower soap dispenser 1 is applicable for a typical water supply pipe 2 and the shower head 3, such as a wall-fixed shower head 3. In installation, the shower head 3 is rotatably disconnected from the water supply pipe 2, and the water pipe 10 of the shower soap dispenser 1 is screwed between the water supply pipe 2 and the wall-fixed shower head 3, as illustrated in FIGS. 1 and 2. Thereafter, if the on/off valve 30 is at the open position, the two rotatable knobs 32 are rotated to further rotate the housing 31, hence the on/off valve 30 is shifted to the closed position, thus closing the two feeding holes 16, as shown in FIG. 4. Thereafter, the shower soap cartridge 20 filled with the soap liquid L is connected with the pipe joint 15, thus finishing the assembly of the shower soap dispenser 1.

While the shower soap cartridge 20 is connected with the pipe joint 15, the soap liquid L is pushed by the spring 25 via the plug 23 and flows into the tunnel 151 of the pipe joint 15 and the two feeding holes 16. In the meantime, the on/off valve 30 is shifted to the open position as shown in FIG. 13, and then a soap liquid L in the two feeding holes 16 are pushed to further flow into the groove 131 and the valve hole 311 of the housing 31, such that a soap liquid L in the groove 131 and the valve hole 311 mix with a shower water W flowing into the channel 14 from the water supply pipe 2, so the shower soap water M produces and flows into the shower head 3.

When the seal element 22 of the shower soap cartridge 20 is connected with or disconnected from the water pipe 10, it is pushed away or produces a self-sealing effect. Accordingly, the shower soap cartridge 20 is removed randomly so as to replace another shower soap cartridge 20 filled with another soap liquid L based on using requirement. The soap liquid L and the another soap liquid L are shower cream, shampoo, or essence.

Preferably, after the shower soap cartridge 20 runs out of the soap liquid L, the spring 25 is biased against the seal element 22, and then the user replaces another shower soap cartridge 20 or refills another soap liquid L into the shower soap cartridge 20, wherein the user removes the shower soap cartridge 20 and then refills the another soap 20 into the shower soap cartridge 20, or the shower soap cartridge 20 is kept at its original position and the another soap liquid L is refilled therein. Anyway, before refilling the another soap liquid L, the cover 20 is rotatably removed, and then the spring 25 and the plug 23 are removed so that the another soap liquid L is refilled into the cylindrical cavity 214 of the housing 21. However, a maximum height of refilling the another soap liquid L has to be limited so as to facilitate the installation of the spring 25 and the cover 24 and to let the spring 25 have a preferred compression force. According to calculation or actual test, the maximum height is controlled by selecting a spring element with a suitable free length and elasticity coefficient. After determining the maximum height, the user is capable of refilling the another soap liquid L at suitable quantity in some ways. As shown in FIG. 3, the housing 21 is made of transparent material and has a graduation indicator 26 marked thereon so that the user exactly refills the another soap liquid L at suitable quantity. A soap refill or a supplement package in the specific capacity is applicable as well. After refilling the another soap liquid L, the plug 23, the spring 25, and the cover 24 are fixed once more, thus refilling the another soap liquid L easily.

Thereby, the shower soap dispenser 1 of the present invention is operated easily by rotating the two rotatable knobs 32 of the on/off valve 30 to the open position or the close position so as to supply soap or to stop supplying soap. In addition, the soap liquid L is fed into the shower water W by means of the spring 25 without decreasing water flow. Also, soap supply will not be influenced by water pressure. In other words, the soap is supplied well at a lower water pressure. Therefore, the disadvantages of conventional soap supply by using water-power or electricity to drive pump is eliminated.

Preferably, the shower soap cartridge 20 includes the spring 25 for indirectly acting on the seal element 22 so as to produce the self-sealing effect, the shower soap cartridge 20 is removed from the water pipe 10 randomly, and a soap liquid L in the shower soap cartridge 20 will not leak. Accordingly, different shower soap cartridges 20 are capable of being removed or replaced according to using requirement.

In addition, the water pipe 10 of the shower soap dispenser 1 extends outwardly along the water supply 2 and the shower head 3, and the shower soap cartridge 20 obloquies toward the upper segment 11 of the water pipe 10, so the shower soap cartridge 20 doesn't interfere the user or is hit by the user in a shower.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A shower soap dispenser installed in a water supply pipe and a shower head of a shower system and comprising:

a water pipe including an upper segment for connecting with the water supply pipe, a lower segment for coupling with the shower head, and a seat defined between and communicating with the upper segment and the lower segment; a channel passing through the upper segment, the lower segment, and the seat; a pipe joint connecting with the seat and extending outwardly from an outer wall of the water pipe; the seat having a groove defined therein and communicating with the channel; the pipe joint having a tunnel defined therein; at least one feeding hole formed on the seat so as to communicate with the groove and the tunnel; the pipe joint also having an abutting portion and at least one orifice defined on a distal end thereof;

a shower soap cartridge including a body, a seal element, a plug, a cover, and a resilient element, wherein the body has a chamber portion, a first connecting portion mounted on one end of the chamber portion, and a second connecting portion disposed on another end of the chamber portion; the chamber portion has a cylindrical cavity defined therein; the first connecting portion is coupled with the pipe joint of the water pipe and has an outlet communicating with the cylindrical cavity, and a diameter of the outlet is smaller than that of the cylindrical cavity, the second connecting portion has an intake communicating with the cylindrical cavity;

the seal element is placed into the body from the intake and axially moves in the cylindrical cavity so as to stop the outlet communicating with the cylindrical cavity; and between an external rim of the seal element and the cylindrical cavity is defined a slit; when the first connecting portion of the body couples with the pipe joint of the water pipe, the seal element is pushed by the abutting portion of the pipe joint to move toward the intake, thus removing from the outlet;

the plug is placed into the body from the intake and axially moves in the cylindrical cavity, such that between the plug and the seal element is defined a store room so as to store a soap liquid filled from the intake of the body, and as the soap liquid runs out, the plug is biased against the seal element;

the cover is connected with the second connecting portion of the body so as to close the intake;

the resilient element is fixed between the cover and the plug so that the plug is pushed by the resilient element to press a soap liquid in the store room toward the outlet during which the soap liquid forces on the seal element, so before the first connecting portion of the body couples with the pipe joint of the water pipe, the seal element stops the outlet communicating with the cylindrical cavity, and when the first connecting portion of the body is in connection with the pipe joint of the water pipe, the soap liquid is pressed into the tunnel from the slit through the at least one orifice;

an on/off valve is installed on the seat of the water pipe and includes a housing fixed in the groove and moving between a close position and an open position, the housing includes a valve hole communicating with the channel and closes the at least one feeding hole when the on/off valve is fixed at the close position, such that a soap liquid in the tunnel of the pipe joint does not flow into the channel via the at least one feeding hole, and when the on/off valve is fixed at the open position, the housing removes from the at least one feeding hole, so the soap liquid in the tunnel of the pipe joint flows into the channel via the at least one feeding hole and then mixes with a shower water flowing through the channel so as to produce a shower soap water, thereafter the shower soap water is guided into the shower head.

2. The shower soap dispenser as claimed in claim 1, wherein the seat has a horizontal through aperture passing through the channel so as to define the groove in the seat, and a diameter of the horizontal through aperture is greater than that of the channel so that the groove has two fixing walls defined on two sides thereof and two opposite concave faces formed between the two fixing walls, wherein one of the two concave faces is adjacent to the pipe joint and passing through the two feeding holes; the housing is formed in a column shape and rotates between the close position and the open position; the housing also has a passage defined on a middle portion thereof so as to form the valve hole and has two opposite convex faces defined on an outer surface of the middle portion thereof so as to contact with the two concave faces of the seat; the housing further has two closing walls arranged on two sides of the two convex faces thereof so as to close the two fixing walls and has two coupling portions mounted on two sides of the closing walls thereof; the on/off valve further includes two rotatable knobs disposed on the two sides of the groove of the seat and coupling with the two coupling portions of the housing so that the housing is axially limited in the groove, and each rotatable knob is rotated to drive the housing.

3. The shower soap dispenser as claimed in claim 2, wherein the channel of the water pipe has a projected portion defined therein; a predetermined portion of a concave face adjacent to the pipe joint is formed on the projected portion, and the two feeding holes pass through the predetermined portion of the concave face which is formed on the projected portion.

4. The shower soap dispenser as claimed in claim 2, wherein the housing also has two O-shaped rings secured on the closing walls so as to close the two fixing walls of the seat.

5. The shower soap dispenser and shower soap cartridge as claimed in claim 2, wherein the seat also has a circular tab arranged around an opening of one of the two fixing walls, and the circular tab has a limit recess defined thereon; the housing has a limiting protrusion fixed on a coupling portion relative to the circular tab so that the limiting protrusion is retained in the limit recess of the seat, such that the housing is limited to rotate between the close position and the open position relative to the limit recess.

6. The shower soap dispenser as claimed in claim 2, wherein the housing has two opposite notches and two opposite cutouts defined on each coupling portion; the two rotatable knobs are formed in a sleeve shape and are fitted onto the two coupling portions, wherein each rotatable knob has two opposite hooks and two opposite insertions fixed therein, such that the two hooks retain with the two notches, so the two rotatable knobs connect with the two coupling portions, and the two insertions are inserted into the two cutouts so that the two rotatable knobs rotate circumferentially along the two coupling portions of the housing.

7. The shower soap dispenser as claimed in claim 1, wherein the water pipe includes two feeding holes formed on the seat so as to communicate with the groove and the tunnel.

8. The shower soap dispenser as claimed in claim 1, wherein the seal element is circular, and a diameter of the external rim of the seal element is smaller than a diameter of an inner surface of the cylindrical cavity, such that the slit is defined between the external rim of the seal element and the inner surface of the cylindrical cavity.

9. The shower soap dispenser as claimed in claim 8, wherein the cylindrical cavity of the body has a closing fence formed therein and around the outlet so as to contact with the seal element, such that the seal element stops the outlet communicating with the cylindrical cavity.

10. The shower soap dispenser as claimed in claim 9, wherein the pipe joint of the water pipe has an outer screwing section formed around an outer surface thereof and has an abutting portion arranged on a top end thereof, and the first connecting portion of the body has an inner screwing section arranged around an inner surface of the outlet, such that the inner screwing section of the body is screwed with the outer screwing section of the pipe joint, the abutting portion inserts into the cylindrical cavity via the outlet when the water pipe connects with the shower soap cartridge, so the seal element is pushed by the abutting portion to move toward the plug; the pipe joint has two gaps defined on the distal end thereof so as to from the two orifices, and a part of the pipe joint enters into the cylindrical cavity when the shower soap cartridge connects with the pipe joint so as to communicate the slit with the tunnel.

11. The shower soap dispenser as claimed in claim 1, wherein the second connecting portion also has second inner threads arranged around an inner surface of the intake; the cover has an end wall formed on a top end thereof and has a peripheral wall integrally extending outward from the end wall; the peripheral wall of the cover has second outer threads arranged thereon so as to screw with the second inner threads of the second connecting portion of the body, such that the cover connects with the body, and the end wall of the cover abuts against the intake of the housing; the peripheral wall has a slot defined therein so as to receive the resilient element.

12. The shower soap dispenser as claimed in claim 1, wherein an extending direction of the two feeding holes is identical to that of the pipe joint, and the two feeding holes and the pipe joint incline toward the upper segment, such that an angle is defined between an axial line of the pipe joint and that of the channel, and the angle θ is between 30 and 60 degrees.

13. The shower soap dispenser as claimed in claim 12, wherein the angle θ is 45 degrees.

14. The shower soap dispenser as claimed in claim 1, wherein the upper segment of the water pipe has an inner threaded section formed on an opening thereof so as to screw with the first outer threads of the water supply pipe, such that the water pipe is connected with the water supply pipe, and the lower segment of the water pipe has an outer threaded section formed on an opening thereof so as to screw with the first inner threads of the shower head, such that the water pipe is connected with the shower head.

15. The shower soap dispenser as claimed in claim 1, wherein the resilient element is a spring.

16. A shower soap cartridge connected with a pipe joint of a water pipe, and the pipe joint including an abutting portion formed thereon; the water pipe installed between a water supply pipe and a shower head of a shower system; the shower soap cartridge comprising:

a body including a chamber portion, a first connecting portion mounted on one end of the chamber portion, and a second connecting portion disposed on another end of the chamber portion; the chamber portion including a cylindrical cavity defined therein; the first connecting portion being coupled with the pipe joint of the water pipe and having an outlet communicating with the cylindrical cavity, and a diameter of the outlet being smaller than that of the cylindrical cavity, the second connecting portion having an intake communicating with the cylindrical cavity;

a seal element being placed into the body from the intake and axially moving in the cylindrical cavity so as to stop the outlet communicating with the cylindrical cavity; and between an external rim of the seal element and the cylindrical cavity being defined a slit; when the first connecting portion of the body couples with the pipe joint of the water pipe, the seal element being pushed by the abutting portion of the pipe joint to move toward the intake, thus removing from the outlet;

a plug being placed into the body from the intake and axially moving in the cylindrical cavity, such that between the plug and the seal element is defined a store room so as to store a soap liquid filled from the intake of the body, and as the soap liquid runs out, the plug being biased against the seal element;

a cover being connected with the second connecting portion of the body so as to close the intake;

a resilient element fixed between the cover and the plug so that the plug is pushed by the resilient element to press a soap liquid in the store room toward the outlet during which the soap liquid forces on the seal element, so before the first connecting portion of the body couples with the pipe joint of the water pipe, the seal element stopping the outlet communicating with the cylindrical cavity, and when the first connecting portion of the body is in connection with the pipe joint of the water pipe, the soap liquid being pressed into the pipe joint from the slit through at least one orifice of the pipe joint.

17. The shower soap cartridge as claimed in claim 16, wherein the seal element is circular, and a diameter of the external rim of the seal element is smaller than a diameter of an inner surface of the cylindrical cavity, such that the slit is defined between the external rim of the seal element and the inner surface of the cylindrical cavity.

18. The shower soap cartridge as claimed in claim 17, wherein the cylindrical cavity of the body has a closing fence formed therein and around to the outlet so as to contact with the seal element, such that the seal element stops the outlet communicating with the cylindrical cavity.

19. The shower soap cartridge as claimed in claim 18, wherein the first connecting portion of the body has an inner screwing section arranged around an inner surface of the outlet, such that the inner screwing section of the body is screwed with the outer screwing section of the pipe joint, the abutting portion inserts into the cylindrical cavity via the outlet when the water pipe connects with the shower soap cartridge, so the seal element is pushed by the abutting portion to move toward the plug.

20. The shower soap cartridge as claimed in claim 16, wherein the second connecting portion also has second inner threads arranged around an inner surface of the intake; the cover has an end wall formed on a top end thereof and has a peripheral wall integrally extending outward from the end wall; the peripheral wall of the cover has second outer threads arranged thereon so as to screw with the second inner threads of the second connecting portion of the body, such that the cover connects with the body, and the end wall of the cover abuts against the intake of the housing; the peripheral wall has a slot defined therein so as to receive the resilient element.

21. The shower soap cartridge as claimed in claim 16, wherein the resilient element is a spring.

* * * * *